United States Patent [19]

Argyropoulos

[11] Patent Number: 5,040,550

[45] Date of Patent: Aug. 20, 1991

[54] TOBACCO TREATMENT APPARATUS AND PROCESS

[76] Inventor: John Argyropoulos, 45 A. Komninon Street, Oreokastron, 570 13 Thessaloniki, Greece

[21] Appl. No.: 200,281

[22] Filed: May 31, 1988

[51] Int. Cl.[5] ..... A24B 3/18; A24B 5/14; A24B 5/16; A24B 15/24

[52] U.S. Cl. ..... 131/297; 131/324; 131/303; 131/304; 131/325

[58] Field of Search ..... 131/297, 298, 303, 304, 131/324, 325

[56] References Cited

U.S. PATENT DOCUMENTS 3,874,392 4/1975 DeBrunn ..... 131/297

FOREIGN PATENT DOCUMENTS 49337 2/1974 Greece .
53819 1/1976 Greece .
53820 1/1976 Greece .
56850 10/1978 Greece .
61221 10/1978 Greece .

*Primary Examiner*—V. Millin
*Attorney, Agent, or Firm*—Charles N. Quinn

[57] ABSTRACT

Dried tobacco leaves evenly spread by a vibrator, cleaned and sorted out, are directed through the opening of two converging cylinders, and tightly held on between two belts.

Now, the belts carrying the leaves, enter into a hot wash basin full of warm water at a temperature of 40 degrees C. They are washed for 4–5 minutes and moved thereafter into a second basin with water heated at 100 degrees C. The bathing of the leaves takes 6–8 seconds and immediately thereafter they are moved into a third, filled with cold water. The three consecutive baths cause the removal by extraction of resins, tars and nicotine. Dissolved by the water and washed away also the are pesticides.

The cold water washes away the nitrogenous substances. Hydrolysis removes the textrines. If stronger intervention is desired, the leaves after the first bath may be directed into freezing dry chamber.

The wet leaves fall now into another system of reversible conveyors, located in a heated tunnel. In the first part the tunnel is heated at 65 degrees C., completing the conversion of the remnants of the proteins and starchy substances into glucose. In the second stage, the temperature is raised to 95–100 degrees C., which converts glucose into caramel. Acetic acid solution may be used for spraying of the leaves at their exit.

The final phase is one of dehydration, making the leaves porous and improving combustibility.

26 Claims, 2 Drawing Sheets

TOBACCO TREATMENT APPARATUS AND PROCESS

FIELD OF THE INVENTION

This invention relates generally to apparatus and processes for treating tobacco to remove a substantial portion of the undesirable substances therefrom before the tobacco is incorporated into cigarettes, cigars and the like.

BACKGROUND OF THE INVENTION AND DESCRIPTION OF THE PRIOR ART

Printed prior art includes the following U.S. Pat. Nos. 3,690,328, 3,817,259, 3,821,960, 3,S74,392, 4,153,063, 4,161,953, 4,183,364, 4,250,898, 4,343,317, 4,392,501, 4,483,353, 4,557,280 and 4,622,982.

Yet additional prior art includes Greek patent 49,337, dated Feb. 28, 1974, relating to processing of green tobacco leaves, Greek patent 53,820, dated Jan. 12, 1976, relating to processing of green tobacco leaves, Greek patent 53,819, dated Jan. 12, 1976, relating to processing of green tobacco leaves, Greek patent 56,850, dated Oct. 9, 1978 and Greek patent 61,221, dated Oct. 9, 1978 relating to processing of green tobacco leaves to remove harmful substances therefrom.

Also known to Applicant are the following textbooks: *Organic Chemistry* by N. E. Alexandrou and A. G. Barboli, 3rd Edition, printed 1981 at Thessalonica, Greece, *Chemistry of Foods* by S. Galanos, Vol. 4, page 62, page 90 and 92, printed at Athens, Greece, 1950, *Special Agriculture Tobacco* by A. Sficas, pages 518, 521 and 444, published at Thessalonica, Greece, *General & Special Pharmacology & Toxicology* by W. Forth, D. Henschler and W. Rummel, date unknown, *Organic Chemistry,* 2nd Edition, by L. and M. Fieser, page 566, published in London, 1953, and *Inorganic Chemistry,* published in 1964 by HolmanViberg.

SUMMARY OF THE INVENTION

In one of its aspects, this invention provides a process for reducing levels of undesirable substances in dried tobacco leaves. The process includes compressing stem portions of the leaves by passing the leaves through spaced apart rotating cylinders as the leaves advance longitudinally within a bed, thereby crushing but not breaking the stems of the leaves while leaving the venous laminae portion of the leaves substantially uncompressed. The process further includes washing the leaves, after the stem portions have been compressed, in lukewarm water until the leaves are soft, washing the leaves in boiling water for a period of between about six and eight seconds, washing the leaves in relatively colder water which is at a temperature less than room temperature, removing residual water from the leaves by draining and gently squeezing the leaves, maintaining the leaves in a dark essentially air-tight environment at about 65 degrees C. for a time sufficient to convert residual proteins and starches in the leaves to glucose and drying the leaves at about 110 degrees C. for sufficient time to dehydrate the leaves.

Preferably, individual tobacco leaves are spread over a moving bed at the initial stage of the process such that a maximum of three leaves thickness results on the bed. The bed advances to move the leaves in a longitudinal direction. During this time the leaves are preferably oriented on the bed with the stems of the leaves substantially parallel with the longitudinal direction. Once the leaves are so-oriented, the stem portions of the leaves may be compressed by passing the leaves between rotating cylinders which are preferably spaced about two (2) millimeters apart as the leaves advance longitudinally with the bed, to crush only the stem portions of the leaves.

The leaves are conveyed through a water bath which is above room temperature, preferably at about 40–45 degrees C., for a period sufficient to soften the leaves.

After removing the leaves from the water, the leaves are drained and gently squeezed to remove the Water therefrom. The leaves are then conveyed through a darkened environment, in the absence of outside air, and are heated in an oven at a temperature of about 65 degrees C. for from about six to about ten minutes and in any event for time sufficient to convert residual proteins and starches in the leaves to glucose. The leaves are then further heated in an oven which is at a temperature from about 85 to about 100 degrees C. for sufficient time to convert the glucose in the leaves into caramel. Subsequent to this, the leaves may be bathed with a solution of dilute acetic acid and are then conveyed through a dark drying environment, heated to about 110 to about 120 degrees C., with time of conveyance being sufficient to fully dehydrate the leaves and thereby result in removal of undesired substances from the leaves.

In the process, the leaves are advantageously conveyed at constant speed and ar conveyed through the water baths while confined between longitudinally moving upper and lower layers of netting or webs. Conveying is preferably uninterrupted. The leaves are preferably at least slightly stirred or agitated while being conveyed through the bath of boiling water between the moving webs.

To remove water from the leaves, the leaves are preferably conveyed substantially vertically during a draining and squeezing operation so that drained water falls from the leaves back into the preceding water bath which is the last-encountered of the three water baths.

The leaves may further advantageously be dried during the draining and squeezing operation by directing air at the leaves while the leaves are conveyed. Conveying is preferably performed by retaining the leaves between two essentially parallel netting sheets moving generally vertically and directing air at the leaves from both sides of the netting. Preferably, squeezing is performed by serially passing the leaves through a plurality of pairs of rollers.

While in the darkened environment, the leaves are retained in a slightly compressed condition, between a pair of webs moving to convey the leaves. The webs which convey the leaves through the darkened environment are preferably hydrophilic opaque substantially air-impermeable Webs and are spaced together sufficiently to slightly compress the leaves so that ambient air cannot reach the leaves while the leaves are between the webs.

In another of its aspects, the invention provides a process for reducing levels of undesirable substances in dried tobacco leaves which includes compressing only stem portions of the tobacco leaves by passing the leaves between two rotating cylinders spaced about two (2) millimeters apart as the leaves advance longitudinally within a bed, thereby crushing but not breaking the stems of the leaves while leaving venous laminae portions of the leaves substantially uncompressed. The process further includes washing the leaves in lukewarm water until the leaves are soft, freezing the leaves to a temperature well below zero (0) degrees C. by placing the leaves in a sub-zero environment, thawing the leaves in a room temperature environment, draining the leaves of water while gently squeezing the leaves to remove water therefrom, conveying the leaves through a darkened environment in the absence of outside air, where conveyance is first through an area heated to about sixty five (65) degrees C. in which the leaves remain resident for from about six (6) to about ten (10) minutes and in any event for time sufficient to convert residual proteins and starches in the leaves to glucose. The second phase of conveying the leaves through a darkened environment in the absence of air is performed in an area heated to a temperature from about eighty-five (85) to about one hundred (100) degrees C. with the leaves remaining in this environment for a sufficient time to convert the glucose into caramel. The leaves then are conveyed through a dark drying environment heated to about one hundred ten (110) to one hundred twenty (120) degrees C. for time sufficient to fully dehydrate the leaves.

In yet another of its aspects, the invention provides apparatus for reducing levels of undesirable materials in tobacco leaves preparatory to smoking thereof. The apparatus includes a plurality of tanks for holding aqueous solutions for treatment of the tobacco leaves in the respective tanks. The apparatus further includes means for crushing substantially only the stem portions of the leaves, means for orienting the leaves with their main stem portions substantially longitudinally aligned, means for conveying the leaves serially through the tanks while maintaining the leaves substantially unrolled, means for removing water from the surfaces of the leaves upon the leaves exiting a final one of the tanks, first oven means for drying the leaves in a two-stage process in respective chambers of the first oven, means for receiving the leaves from the water removal means and conveying the leaves through the first oven means in a condition in which the leaves are shielded from light and from incoming air, second oven means for drying the leaves and means for receiving the leaves from the first oven means and conveying the tobacco leaves back and forth along vertically spaced segments of an essentially horizontal path through the second oven means in a condition in which the leaves are shielded from light and incoming air.

The invention permits removal of undesirable components of tobacco by reducing the levels of those components to levels required by physicians and chemists, but without reducing these levels to zero. (Such reduction to zero of the undesired components in the tobacco would render the tobacco tasteless and therefore unsatisfactory to the smoker.) The reduction of the undesired constituents of the tobacco leaves, such as nicotine, total nitrogen, nitrates, sulfur and tars which are inhaled by the smoker and by non-smokers in closed rooms, when using the invention, varies from considerable to spectacular.

The invention has applicability to Oriental tobacco, burleys and Virginia-type tobaccos.

The invention may also be used to remove undesirable substances from green tobacco leaves provided however that the green tobacco leaves must be removed from the growing field in a fully matured state and placed in fermentation chambers where their color must change completely from green to brown before the process of this invention may be utilized.

In processing the tobacco leaves, the processor may define the preferable limits of the reduction of the undesirable compounds so that the smoker may experience satisfactory taste and tangible coolness, even though the smoking has been made considerably less hazardous.

Using the invention, the unpleasant smoky taste of albumin-protein compounds of untreated tobacco leaves is partly replaced by a pleasant smooth taste provided by increased starchy compounds to which part of the albumin-proteins in the treated tobacco leaves are converted in the process of the invention.

Through the increased combustibility of the processed tobacco leaves, the invention reduces the amount of inefficient combustion products of untreated tobacco as tar and carbon monoxide. The resultant increased combustibility allows a cigarette manufacturer to avoid using cigarette wrapping paper impregnated with nitrates to increase combustibility; this is desirable since nitrates are harmful to the smoker.

The invention exhibits a 32.5% reduction in weight of the processed tobacco as a result of substantial reduction of undesired substances. This weight loss and consequent economic loss is compensated for, in part, by the ability to wash solubles present in the water of the tanks. Since after use this water is rich in nicotine, it may be used to control insects, such as aphids, by suitable application to growing plants.

The loss in weight of the treated tobacco is further compensated for (economically) by the increase in volume of the tobacco. Since cigarettes have the same volume, regardless of their weight, the cigarette manufacturer produces the same number of cigarettes from an equal volume of tobacco leaves when using the invention.

When a smoker smokes an equal number of cigarettes using unprocessed tobacco and using tobacco processed according to the invention, the smoker inhales about one-third less smoke in smoking cigarettes having tobacco processed according to the invention, as compared to cigarettes having unprocessed tobacco, thereby reducing substantially the adverse effects of the undesirable compounds in tobacco.

DESCRIPTION OF THE PREFERRED EMBODIMENTS AND BEST MODE KNOWN FOR PRACTICING THE INVENTION

Figure 1:
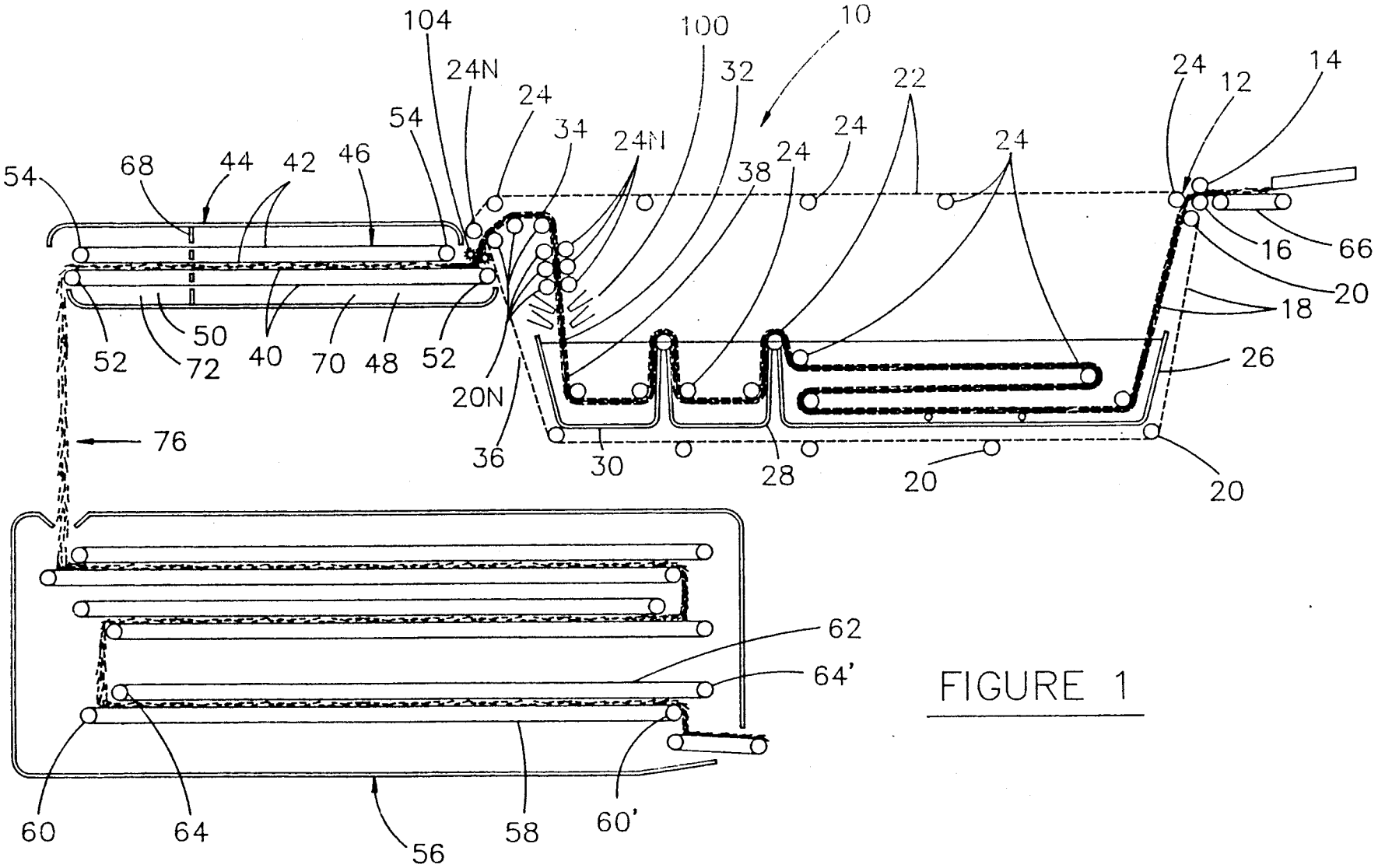
FIG. 1 is a schematic representation of apparatus suitable for processing tobacco leaves according to the invention.
Figure 2:
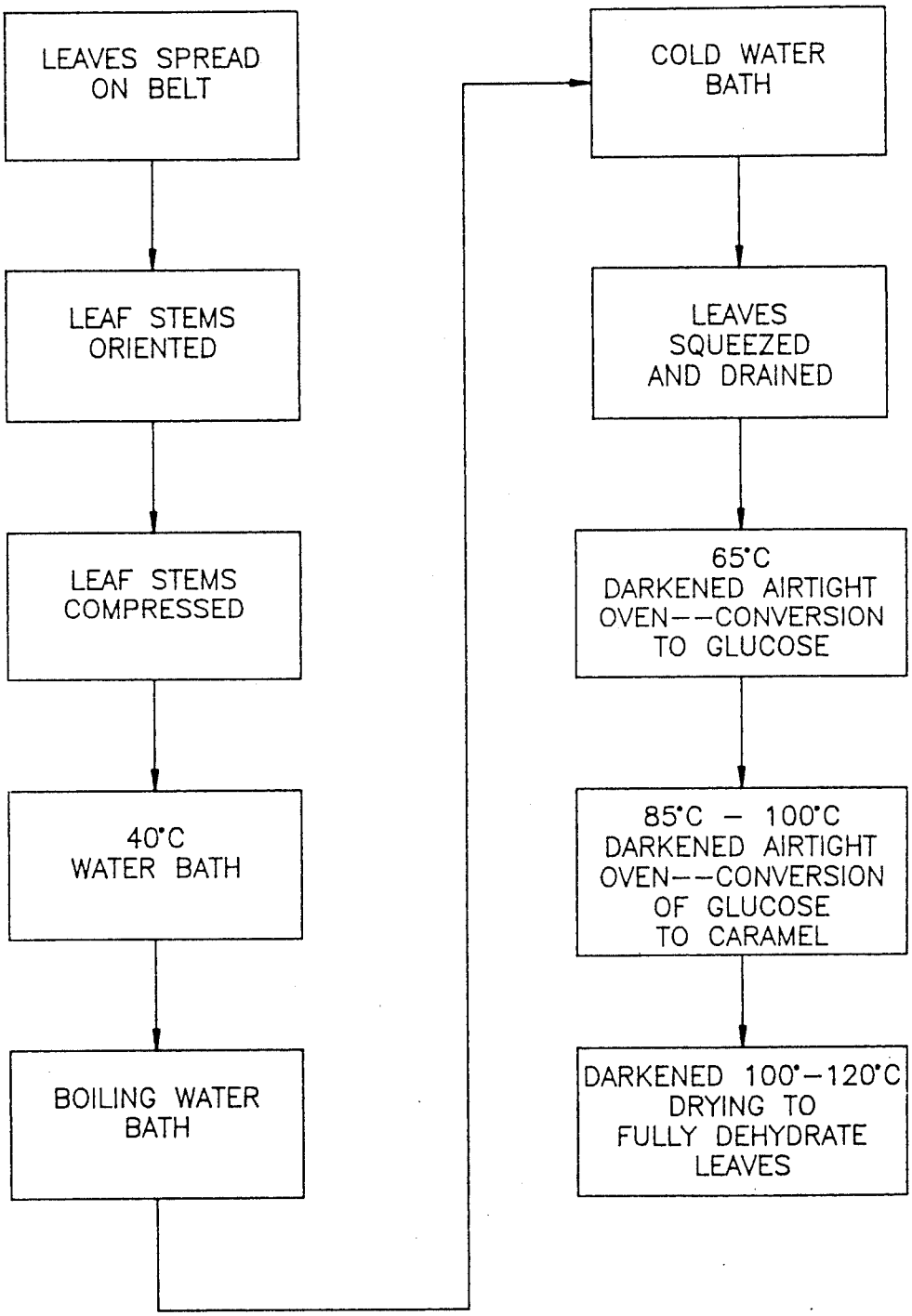
FIG. 2 is a flow diagram illustrating a process for treating tobacco leaves according to the invention.

Referring to FIG. 1, apparatus 10 for practicing the invention includes a first pair 12 of nip rollers 14, 16 where the rollers 14, 16 are spaced close together, preferably about two millimeters apart at their point of closest approach. It is preferable that rollers 14, 16 have teflon surfaces, to prevent the tobacco leaves from sticking to the roller surfaces. Roller pair 12 defines the initial part of a path for carriage of tobacco leaves through the apparatus so that the leaves may be processed according to the process aspect of the invention.

A first or lower web 18 is supported by a plurality of rollers 20, of which roller 14 is one member. A second web 22 is similarly supported by a plurality of rollers 24, of which roller 16 is a member. Some of rollers 20, 24 are spaced closely together, in the manner of nip rollers, to maintain webs 18, 22 close to one another to retain the tobacco leaves therebetween and for transporting the tobacco leaves along a path in order that the tobacco leaves may be processed according to the process of the invention.

Rollers 20 provide a continuous path or loop for web 18 with those ones of rollers 20, which act with corresponding ones of rollers 24 to define nip roller pairs, being denoted 20N. Likewise, those rollers of rollers 24 which act with corresponding rollers 20N to define nip roller pairs are denoted 24N. Pairs of nip rollers 20N, 24N, being positioned closely together, keep webs 18, 22 in close proximity one to another and thereby maintain the tobacco leaves between webs 18, 22, as the webs travel to process the tobacco leaves according to the invention. Remaining ones of rollers 20, 24 are positioned to define endless loop paths for webs 18, 22, as illustrated.

Three solution tanks 26, 28, 30 respectively are provided for serial transport of the tobacco leaves therethrough as the leaves are retained between webs 18, 22. Rollers 20N, 24N are positioned so that webs 18, 22 pass serially through tanks 26, 28, 30 thereby bathing the tobacco leaves sequentially in liquids within the three tanks. Tank 26 preferably has water at about 40 degrees C. Tank 28 preferably has boiling water while tank 30 preferably has cold water, at a temperature at least slightly below room temperature.

Upon exiting tank 30, webs 18, 22 rise upwardly due to the positioning of rollers 20N, 24N, which are in substantially vertical rows above tank 30. As webs 18, 22 are conveyed upwardly and constrained to move in such direction by rollers 20N, 24N above tank 30, the rollers press much of the remaining water out of the tobacco leaves retained between Webs 18, 22, and the water flows downwardly, into tank 30.

Further above tank 30, air jets 100 are directed at respective outwardly facing surfaces 36, 38 of webs 18, 22, to dry tobacco leaves retained between webs 18, 22.

As the tobacco pass between nip rollers 20N, 24N at the left-hand extremity of first and second webs 18, 22 in FIG. 1, the leaves drop onto a web 40 which, together With a web 42, located within a first oven 44, define a second pair of moving flexible webs. The second pair of webs defined by webs 40, 42 is designated generally 46.

Oven 44 has two chambers, a first chamber designated generally 48 and a second chamber designated generally 50. First chamber 48 is at about 65 degrees C. while second chamber 50 is at between about 85 and about 100 degrees C. The tobacco leaves are conveyed through first over 44 between webs 40, 42, as illustrated in FIG. 1. Preferably, the leaves remain in first chamber 48 for from about six (6) to about ten (10) minutes. In any event, the leaves remain in first chamber 48 for time sufficient to convert residual proteins and starches in the leaves into glucose.

The leaves remain in second chamber 50 for sufficient time to convert the glucose into caramel. While the configuration of webs 40, 42 has been illustrated in FIG. 1 as providing a single, straight line path (defined by space between webs 40, 42) for the tobacco through chambers 48, 50 of first oven 44, a sinuous path may also be advantageously employed, to reduce the floor area required for first oven 44.

Webs 40, 42 are both substantially hydrophilic opaque substantially air-impermeable in the sense that while water vapor from the leaves at a slight partial pressure above atmosphere may escape from the leaves through the Webs, air substantially cannot pass from the outside through the webs and reach the leaves. Webs 40, 42 are positioned on rollers 52, 54 so that the leaves are conveyed through first oven 44 in a compressed condition. The hydrophilic, opaque and substantially air-impermeable characteristic of webs 40, 42 results in the tobacco leaves being conveyed through first and second chambers 48, 50 of oven 44 in an essentially air-tight environment, which is dark. This environment, together with the elevated temperature of first chamber 48, contributes to rapid conversion of residual proteins and starches in the leaves into glucose. Similarly, the dry, darkened environment as the leaves are conveyed through second chamber 50 at an elevated temperature contributes to efficient conversion of glucose into caramel.

After having been conveyed through first oven 44, the leaves are released from between webs 40, 42 and permitted to drop into a second oven 56 and to be received on a web 58 within second oven 56. Second oven 56 has a plurality of web-roller combinations therein, disposed as upper and lower web-roller combinations. Web 58, together with rollers 60, 60' define a lower web-roller combination. Similarly, web 62, together with rollers 64, 64' define an upper web-roller combination within second oven 56. As illustrated in FIG. 1, lower webs, such as web 58, within second oven 56, are longitudinally slightly longer than upper webs, such as web 62 within oven 56 so that respective lower webs may receive tobacco leaves which have been conveyed between next higher pairs of webs within second oven 56. Specifically, the left extremity of web 58 within second oven 56 is horizontally offset respecting the left extremity of web 62 within second oven 56 for web 58 to receive tobacco leaves falling vertically downwardly onto web 58. The same configuration exists with lower webs extending outwardly beyond the respective corresponding extremities of an upper web end, to facilitate receipt of tobacco leaves by a respective lower web within second oven 56.

If desired, and it is advantageous to do so, the tobacco leaves may be sprayed with dilute acetic acid, as indicated by arrow 76, in the vicinity of oven 44 as the leaves are conveyed or dropped between first and second ovens 44, 56.

Second oven is preferably maintained at about 110 to 120 degrees C. The webs within second oven, similarly to the webs within first oven 44, are hydrophilic, substantially air-impermeable in the sense that while water vapor from the leaves at a slight partial pressure above atmosphere may escape from the leaves through the webs, air substantially cannot pass from the outside through the webs and reach the leaves, and substantially opaque so that as the tobacco leaves are conveyed through second oven 56, the leaves are in a darkened, dry, elevated temperature environment so that the leaves may fully dehydrate. Sufficient webs should be provided within second oven 56 so that the tobacco leaves are conveyed through second oven 56 for sufficient time to fully dehydrate the tobacco leaves. Because of the air-impermeable characteristic of the webs within second oven 56, air cannot reach the leaves as they are conveyed through second oven 56. Likewise, the webs within second oven 56 are sufficiently close together that the leaves are slightly compressed between the pairs of moving webs as the leaves are conveyed.

The process as preferably practiced provides for a continuous conveying of the leaves. The sizes of tanks 26. 28. 30 and the configuration of paths defined by webs 18, 22 therewithin are selected so that the leaves are washed within first tank 26 for sufficient time until the leaves are soft. Similarly, the configuration of the path and tank sizes are selected so that the leaves remain in boiling water within tank 28 for between about six and about eight seconds. The leaves remain in tank 30 for sufficient time to cool down to the temperature of the bath in tank 30, which is lower than room temperature. The conveying is at constant speed.

Agitators are preferably provided within tanks 26, 28 and 30 so that the leaves may be agitated as they are conveyed through the baths of water within the tanks. Webs 18, 22 are preferably a type of netting, to provide substantial access to the tobacco leaves by the water in the various baths and the drying air provided via air jets 100. Unlike the webs in first and second ovens 44, 56, webs 18, 22 are positioned only sufficiently closely so that the leaves can be moved longitudinally; webs 18, 22 are not positioned to significantly compress the leaves together. In fact, such compression is undesirable as the leaves are conveyed through tanks 26, 28, 30 because such compression, if two or more leaves overlap, would reduce the amount of water which could contact the leaves.

Rollers 14, 16 are close together, preferably about two (2) millimeters apart at their point of closest approach, to crush the stem portions of the leaves but to leave the venous laminae portions of the leaves substantially uncompressed and undisturbed. Suitable leaf-orienting equipment, designated generally 66 in FIG. 1, orients the leaves with their major stems substantially longitudinally aligned for travel through the various baths in the longitudinal direction. This orientation facilitates appropriate crushing of the stem portions of the leaves by the rollers.

Webs 18, 22 are preferably netted belts, each about 1.20 meters wide, made of Teflon to minimize the effect of temperature change. The holes in the belts are up to five (5) millimeters in diameter, to permit free flow of water around the tobacco leaves as the leaves are moved through the water and processed in the tanks.

Speed of travel of the various webs of the apparatus of the invention is preferably uniform and regulated by time required for the leaves to remain in the second oven. This is the time required to dehydrate the leaves. Typically, dehydration requires 20 minutes for leaves having stems but only 15 minutes for leaves without stems, at the temperatures noted above for the second oven.

The lengths of the components of the apparatus for the other phases are provided to result in desired residence time of the webs in the various portions of the apparatus.

The leaves typically remain in first tank 26, in a warm water bath of about 40–45 degrees C., from four (4) to five (5) minutes with the leaves being stirred until they are thoroughly washed and have softened.

Passage through second tank 28 lasts only from six (6) to eight (8) seconds, with the leaves being continuously stirred while they are within the boiling water within tank 28.

Third tank 30 has water which is cold; the leaves are washed thoroughly in this cold water.

During the leaf washing, the water soluble components of the leaves are washed away and extracted by the water at the various temperatures. These water-soluble components include resins, tars and a large portion of nicotine. Further carried away with the water are pesticides which may have been used by farmers in growing the tobacco leaves.

The cold water washing in tank 30 dissolves and removes a great part of the nitrogenous substances of ammoniac form (NITRAL). This reduces the nitrogen oxide and pyridine which otherwise results during smoking. Hydrolysis removes dextrines which result in Oriental tobacco from prolonged exposure to sun and resultant heating and in Virginia tobaccos from prolonged heating in curing ovens.

If more vigorous removal of undesirable substances is desired, the tobacco leaves may be introduced into a freezing chamber immediately after leaving first tank 26. The freezing chamber is used in lieu of the boiling water, cold water procedure provided by tanks 28, 30.

When the freezing procedure is used, thawing takes place in water at room temperature. The freezing procedure should be used only in connection with hard tobacco leaves and must be closely regulated because excessive exposure of the leaves to subfreezing temperatures may cause the leaves to crack and lose their desirable characteristics.

Those ones of rollers 20, 24 supporting first and second webs 18, 22 in the vicinity of the air jets, after webs 18, 20 leave tank 30 and travel upwardly, are preferably covered with spongy material to absorb water remaining on the webs and the leaves. The external surfaces of these pairs of rollers touch, as they rotate, and may be grooved to drain the remaining water which empties downwardly into tank 30. Preferably, webs 18, 22 go through four or five pairs of nip rollers, slightly touching each of the rollers as the rollers rotate. This, combined with the positioning of the rollers and the upward path of webs 18, 22 out of tank 30, results in the water drained from the tobacco leaves and webs falling back into tank 30.

A pair of rotating brushes may be utilized to disengage the tobacco leaves from contact with first and second webs 18, 22 at the vicinity of the left-most pair of nip rollers 20, 24 in FIG. 1.

As the leaves are separated from webs 18, 22, the leaves fall onto a horizontally moving web 40 to travel through first oven 44. Web 40 is preferably Teflon while web 42, which bears upon the leaves resting on web 40, is preferably tightly-woven hydrophilic cotton yarn. Web 42 may actually contact web 40 and hence web 42 retains the leaves tightly between it and web 40, helping to prevent air from reaching the tobacco leaves. In the event temperature higher than 100 degrees C. is desired in first oven 44, web 42 may be Teflon, rather than cotton, in which case the temperature in first oven 44 may safely exceed 100 degrees C. As tobacco leaves move with webs 40, 42 through first oven 44, transit time through first oven 44 is the time required for conversion to glucose of the remnants of hydrolysis of the proteins and mainly starchy substances of the leaves. While traveling through first oven 44, the leaves are tightly covered by web 42 to prevent entry of air and light which would otherwise cause oxidation and change the compounds in the leaves.

In the second chamber of first oven 44, the temperature is in the vicinity of 90 to 100 degrees C. to convert the glucose into caramel. At the starting point of the second chamber, paravan 68 is located, separating the high temperature second chamber 70 from the low temperature first chamber 72.

The path through first oven 44 should be long enough to permit advantageous treatment of the tobacco, at these temperatures which result in improving the taste of the tobacco. This taste improvement is accomplished mostly by having the tobacco heated to 65 degrees C., with such heating lasting for a period of from six (6) to about ten (10) minutes. Hence, first oven 42 should be long enough to provide a travel time from six to ten minutes of the tobacco leaves in first chamber 72.

The webs within second oven 56 are preferably Teflon belts which are highly resistant to temperatures in excess of 100 degrees C. In each case, the upper web presses tightly on the leaves underneath, preventing air from reaching the leaves as the leaves are conveyed between the upper and lower webs. Leaves remain in second oven 56 sufficiently long, at the temperature of over 100 degrees C., until the leaves, including their stems, are fully dehydrated. To assure horizontal, even movement of the Teflon belts or webs in both the first and second ovens, it may be desirable to have horizontal metallic wire netting or reinforcing underneath the lower Webs.

Once the tobacco leaves have exited from second oven 56, the leaves may be sold or processed into tobacco products, as soon as the leaves have cooled and have been pressed into bales.

It is important to closely monitor the tobacco leaves once the leaves first dry by application of the air jets in the area above third tank 30 and to continue to monitor the leaves as they travel through first and second ovens 44, 56. This is because it is important that the leaves not become moist once the drying process has begun. Likewise, air and light from outside the drying ovens should be prevented from entering the drying ovens so that no redrying of moistened tobacco is necessary. Such redrying is not recommended and adversely affects results obtained. Moistening and redrying will cause changes of color, taste and aroma.

When tobacco is processed according to the invention, loss of weight from the tobacco leaves may range as high as 30 percent. This is substantially greater weight loss than occurs when merely drying tobacco leaves which is one technique which has been used heretofore. The additional weight loss using the present invention represents increased removal of undesirable substances from the tobacco.

Cigarettes produced from tobacco processed according to the invention, when smoked, give the smoker a pleasant mellow taste and tangible coolness. Moreover, such cigarettes are not as harmful to the smoker as cigarettes known heretofore and, having lower tar and nicotine values, help smokers to reduce their smoking habit, lessening their dependency on these harmful substances.

To demonstrate the efficacy of the invention, a batch of burley tobacco, grown in 1985, was separated into two samples. Sample A was left untreated while Sample B was processed according to the invention utilizing apparatus shown schematically in FIG. 1. Specifically, Sample B tobacco leaves were processed by crushing but not breaking the stems of the leaves while leaving the venous laminae portions of the leaves substantially uncompressed. The leaves were then conveyed into first tank 26 where the leaves were washed in lukewarm water, at about 40 degrees C., until the leaves were soft; this took about six (6) minutes. Next, the leaves were conveyed into tank 28 which held boiling water and were immersed in the boiling water and stirred therein for about eight (8) seconds. The leaves were then removed from the boiling water and conveyed into third tank 30 where they were washed in water at below room temperature. The leaves were then generally conveyed upwardly, sprayed with water and then with air so that the water was removed from the leaf surfaces and drained into tank 30. During this time, the leaves were gently squeezed by the rollers. The leaves were then conveyed through the first oven and remained in first chamber 72 at about 65 degrees C. between the hydrophilic-compressed webs so that the leaves were in a heated, darkened and essentially substantially air-impermeable environment for about six (6) minutes. The leaves were then quickly conveyed through the higher temperature second chamber 70 of first oven 44 and thereupon were conveyed through second oven 56 for a sufficient time to fully dehydrate the leaves, With second oven 56 being at about 120 degrees C.

The leaves of Sample B, which were processed according to the invention, and the leaves of Sample A, which were unprocessed, were then found to have the analyses set forth below:

TABLE 1

| Tobacco Subtance | Sample A (Untreated) | Sample B (Processed According to The Invention) | Reduction (Percent) |
|---|---|---|---|
| Nicotine | 1.49 | 0.34 | −77% |
| Nitrogen | 4.52 | 2.38 | −47% |
| Nitrates | 0.421 | 0.162 | −61% |
| Sugar | Not Detectable | Not Detectable | N.A. |
| Sulphur | 0.46 | 0.28 | −39% |
| Chlorides | 0.70 | 0.70 | 0.0 |
| Ash | 22.30 | 19.87 | −11% |
| Starch | 4.55 | 4.92 | +08% |
| Proteins | 10.87 | 9.75 | −10% |
| Dithiocarbamate (P.P.M.) | Not Detectable | Not Detectable | N.A |
| Organo Chlorines | Not Detectable | Not Detectable | N.A |
| Organo Phosphates | Not Detectable | Not Detectable | N.A. |

As an additional test, tobacco from Sample A and tobacco from Sample B were made into cigarettes, without filters, of 66 millimeters in length. The cigarettes were then smoked in a Filtrona SN-302 instrument, using the method of smoking number ten where the cigarettes were smoked over a length of 23 millimeters. The following table sets forth a comparison between the cigarettes, and their smoke, from the tobacco of Sample A and of Sample B:

TABLE 2

| | Value | | |
|---|---|---|---|
| Parameter | Sample A (Untreated) | Sample B (Processed According To The Invention) | Reduction (Percent) |
| Cigarette Weight (Grams) | 7.788 | 5.253 | 32% |
| Tar (MG/Cigarette) | 15.0 | 11.5 | 23% |
| Nicotine | 0.8 | 0.37 | 50% |

TABLE 2-continued

| Parameter | Value: Sample A (Untreated) | Value: Sample B (Processed According To The Invention) | Reduction (Percent) |
|---|---|---|---|
| in Cloud | | | |
| Carbon Monoxide (MG/Cigarette) | 9.09 | 9.02 | 0.07% |
| Nitrous Oxide (MG/Cigarette) | 0.479 | 0.146 | 69% |
| Combustibility (MM/MIN) | 7.05 | 8.08 | Increase 14% |
| Cloud pH | 6.5 | 6.5 | — |

In all cases, the tobacco leaves should be evenly spread using a vibrator, preferably a Tapirolan band, which may define webs 18, 22 and may be about 1.20 meters wide. When processing Oriental types of tobacco, the leaves can be either single leaves or up to three leaves in thickness on the webs. When processing Burley and Virginia types of tobacco, the leaves may be either single leaves or two leaves in thickness on the webs.

Since American tobacco, particularly Burley and Virginia varieties, has thick stems holding higher percentages of water than the laminae of the leaves, thereby requiring longer processing time than equivalent tobacco leaves having the stems removed, it might ordinarily be considered advantageous to remove the stems from the leaves before processing. However, in the examples set forth above, the stems have not been removed from the tobacco leaves. This demonstrates the efficacy of the invention in that this presents the more difficult processing situation of the two alternatives. The examples set forth above all utilized Burley American tobacco.

It is preferable that the crushing rollers 102 be two smooth surface metallic rotating cylinders spaced two (2) millimeters apart so that the stems are crushed When passing between rollers 102. The stems should be parallel to the direction of movement between the rollers and the stems must be soft so that as the stems pass between the cylinders or rollers the stems crush but do not break. It is desirable that the surfaces of the rollers or cylinders be Teflon to prevent the leaves from sticking to the surfaces of the cylinders or rollers.

When the leaves come through the two cylinders 102, particularly between the nip defined between those rollers, the leaves are carried away with help of other rollers which are initial rollers 14, 16 advancing the upper and lower webs. The webs 18, 22 are each preferably net belts each preferably 1.20 meters wide, made of Teflon, to resist the effect of changing temperatures, with web perforations of up to five (5) millimeters in diameter to permit uninterrupted free flow of water around the leaves as the leaves are conveyed through the tanks for processing.

The speed of movement of the entire system is prearranged, homogeneous and uninterrupted in all phases, specifically the tobacco feeding, the tobacco treatment and the tobacco dehydration. Speed is uniform and is regulated by the time required for the leaves to remain in the chambers for dehydration. Generally dehydration takes place in twenty (20) minutes for leaves having stems and in fifteen (15) minutes for leaves lacking stems.

The size of the components of the apparatus used to perform the other phases of the process is established proportionally to the length of time required for performance of these phases of the process.

As the leaves advance with movement of the webs, the leaves are directed into the initial basin or tank 26 full of warm water at a temperature of 40–45 degrees C. The leaves remain within this bath from four (4) to five (5) minutes and the bath is stirred until the leaves are washed and softened sufficiently to allow removal of all substances which are soluble in water at this temperature.

Once this has been performed, the leaves are directed into the second tank 28 having water heated to 100 degrees C. and hence the water is boiling. Leaf passage through the second tank lasts from six (6) to ten (10) seconds with the water being continuously stirred. This results in the greatest number of cells of the leaves being broken to release the undesirable substances. Subsequently, the leaves are directed into the third tank 30 containing cold water where the leaves are thoroughly washed.

During the washings in the tanks 26, 28, 30, the water soluble components of the leaves are washed away by extraction at various temperatures. These substances include resins which reduce the combustibility and increase the tar of the tobacco and include nicotine. Further dissolved in the water and being washed away from the leaves are pesticides which may have been used in the field in connection with growth of the tobacco. The differences in sizes of the tanks as illustrated in FIG. 1 are provided to effect varying transit times for the tobacco leaves through the three different tanks.

The cold water washing in tank 30 dissolves and removes a great portion of the nitrogenous substances of ammoniac form, better known as nitral, thus resulting in reduced nitrogen oxide and pyridine being reduced during smoking.

If stronger removal of undesirable substances is desired, the tobacco leaves may be conveyed immediately from basin or tank 30 into a freezing chamber and frozen there. In such case, the tobacco leaves are subsequently thawed in water at room temperature.

As the tobacco leaves are conveyed upwardly out of tank 30, the cylinders 20N, 24N in that area are preferably metallic and covered with a spongy material to absorb water remaining in the webs and tobacco leaves.

The rollers 20N, 24N are preferably circumferentially grooved to permit the water squeezed thereby to drain downwardly between the rollers, and drain into tank 30.

Brushes 104 are provided to facilitate separation of the tobacco leaves from webs 18, 22, preparatory to dropping the leaves downwardly from the webs for entry into first oven 44. The brushes are indicated as 104 in FIG. 1. The web onto which the leaves then preferably fall is preferably another Tapirolan type of web made of Teflon on which is rested yet another moving web, which is also preferably a Tapi rolan web, covering the leaves through their movement through first oven 44 which broadly defines the second phase of the process.

The upper web 42 is preferably tightly woven cotton yarn which is preferably hydrophilic and rests o lower web 40 to tightly retain the leaves therebetween.

After leaving the first oven 44 and optionally being sprayed with acetic acid, the tobacco leaves are introduced into second oven 56 where the dehydration is completed at a temperature of in the neighborhood of about 100 and 120 degrees C. The tobacco leaves are again preferably retained between Tapirolan Teflon belts. The dehydration process and escape of moisture from the leaves as steam effectively opens the pores of the leaves, making the leaves porous, improving their combustibility and reducing tar produced when the leaves are smoked. The leaves, which are 5 preferably heated to in excess of 100 degrees C. within second oven 56, remain within second oven 56 until the leaves are fully dehydrated. This includes dehydration of the leaf stems.

In both first and second ovens 44, 56, the webs while referred to herein as being "substantially air-impermeable" are actually slightly porous. The porosity of the webs is sufficiently small that air does not enter the webs and reach the tobacco leaves in any substantial amount. However, because steam or vapor is generated within the tobacco leaves due to heating while within the ovens, the steam or vapor is at a somewhat elevated pressure relative to atmospheric and forces its way through the slightly porous webs as the steam or vapor escapes from the leaves. Hence, steam or Vapor passes through the webs as the steam or vapor outgasses or escapes from the tobacco leaves.

I claim the following:

1. A process for reducing levels of undesirable substances in dried tobacco leaves, comprising:

a. crushing but not breaking stems of said leaves while leaving venous laminae portions of said leaves substantially uncompressed;

b. washing said leaves in lukewarm water until the leaves are soft;

c. washing said leaves in boiling water for a period of between about six and about eight seconds;

d. washing said leaves in colder water which is at temperature less than room temperature;

e. removing residual water from said leaves by draining said leaves and gently squeezing said leaves;

f. maintaining said leaves in a dark essentially air-tight environment, at about 65 degrees C., for time sufficient to convert residual proteins and starches in said leaves to glucose;

g. drying said leaves at about 110 to 120 degrees C. for sufficient time to fully dehydrate said leaves.

2. The method of claim 1 wherein crushing stem portions of said leaves is performed by passing said leaves between two rotating cylinders as said leaves advance longitudinally with said bed, thereby crushing but not breaking stems of said leaves while leaving venous lamine portion of said leaves substantially uncompressed.

3. The method of claim 2 wherein said cylinders are spaced about two millimeters apart.

4. A process for reducing levels of undesirable substances in dried tobacco leaves, comprising:

a. spreading individual tobacco leaves over a moving bed such that a maximum of three leaves thickness results on said bed;

b. longitudinally advancing said bed thereby moving said leaves along the longitudinal direction;

c. orienting said leaves on said bed with stems of said leaves substantially parallel with said longitudinal direction;

d. compressing only stem portions of said leaves by passing said leaves between two rotating cylinders spaced about two millimeters apart as said leaves advance longitudinally with said bed, thereby crushing but not breaking said stems of said leaves while leaving venous laminae portions of said leaves substantially uncompressed;

e. conveying said leaves through a water bath at about 40 degrees C. for a period of between about four and about five minutes and in any event until the leaves are soft;

f. conveying said leaves through a second water bath of boiling water for a period of between about six and about eight seconds;

g. conveying said leaves through a third water bath of colder water, at temperature less than room temperature;

h. draining said leaves of water while gently squeezing said leaves to remove water therefrom;

i. conveying said leaves through a darkened environment, in the absence of outside air:

1. first at about 65 degrees C. for from about six to about ten minutes and in any event for time sufficient to convert residual proteins and starches in said leaves to glucose; and 2. then at a temperature of from about 85 to about 100 degrees C. for sufficient time to convert said glucose into caramel;

j. conveying said leaves through a dark drying environment heated to about 100 to 120 degrees C. for sufficient time to fully dehydrate said leaves.

5. The process of claim 4 wherein said leaves are conveyed at constant speed.

6. The process of claim 5 wherein said conveying is uninterrupted.

7. The process of claim 4 wherein said leaves are conveyed through said water baths while confined between longitudinally moving upper and lower layers of netting.

8. The process of claim 4 wherein said leaves are agitated while being conveyed through said second bath of boiling water.

9. The method of claim 4 wherein said leaves are conveyed substantially vertically during said draining and squeezing so that drained water falls from said leaves into said third water bath.

10. The method of claim 9 further comprising drying said leaves during said draining and squeezing by directing air at said leaves while said leaves are being conveyed.

11. The method of claim 10 further comprising conveying said leaves by retaining said leaves between two essentially parallel sheets of upwardly moving netting and directing air at said leaves from both sides of said netting.

12. The method of claim 11 wherein said leaves are squeezed by serially passing between pairs of rollers.

13. The method of claim 4 wherein said conveying said leaves through a darkened environment further comprises retaining said leaves in a slightly compressed condition between webs moving to convey said leaves.

14. The method of claim 13 wherein said webs are hydrophilic, opaque, substantially air impermeable and compress said leaves sufficiently that ambient air cannot reach said leaves therebetween.

15. The method of claim 4 wherein conveying said leaves through said dark drying environment further comprises retaining said leaves in a compressed condition between a pair of webs moving to convey said leaves.

16. The method of claim 15 wherein at least one of said webs is porous.

17. A process for reducing levels of undesirable substances in dried tobacco leaves, comprising:

a. crushing but not breaking stems of said leaves while leaving venous laminae portions of said leaves substantially uncompressed;

b. washing said leaves in lukewarm water until the leaves are soft;

c. freezing said leaves to a temperature well below 0 degrees C. by placing said leaves in a subzero environment;

d. thawing said leaves in a room temperature environment;

e. draining said leaves of water while gently squeezing said leaves to remove water therefrom;

f. conveying said leaves through a darkened environment, in the absence of outside air:

1. first at about 65 degrees C. for from about six to about ten minutes and in any event for time sufficient to convert residual proteins and starches in said leaves to glucose; and 2. then at a temperature of from about 85 to about 100 degrees C. for sufficient time to convert said glucose into caramel;

g. conveying said leaves through a dark drying environment heated to about 110 to 120 degrees C. for sufficient time to fully dehydrate said leaves.

18. The process of claim 17 wherein said leaves are conveyed at constant speed.

19. The process of claim 18 wherein said leaves are conveyed while confined between longitudinally moving upper and lower layers of netting.

20. The process of claim 19 wherein said conveying is uninterrupted.

21. The method of claim 17 wherein said conveying said leaves through a darkened environment further comprises retaining said leaves in a slightly compressed condition between a pair of webs moving to convey said leaves.

22. The method of claim 21 wherein said webs are substantially hydrophilic, opaque, air impermeable and compress said leaves sufficiently that ambient air cannot reach said leaves therebetween.

23. The method of claim 17 wherein crushing stem portions of said leaves is performed by passing said leaves between two rotating cylinders as said leaves advance longitudinally within a web, thereby crushing but not breaking stems of said leaves while leaving venous laminae portions of said leaves substantially uncompressed.

24. The method of claim 23 wherein said cylinders are spaced about two millimeters apart.

25. Apparatus for reducing amounts of undesirable materials in tobacco leaves for smoking, comprising:

a. three serially disposed, longitudinally spaced tanks, respectively adapted to retain warm water at about 40 degrees C., boiling water and colder water at a temperature below room temperature;

b. a first pair of moving continuous flexible webs, space between said webs defining a path of conveyance for tobacco leaves traveling with said webs through said three tanks, said webs being closely spaced together and parallel one with another along said path through said tanks;

c. a plurality of first roller means for defining the path of said first Web of said first pair;

d. a plurality of second roller means for defining the path of said second web of said first pair;

e. said first and second roller means guiding said webs of said first pair successively through said respective tanks;

f. said first and second roller means defining said path of said webs of said first pair and hence of space between said webs defining said path for said tobacco upwardly out of said third tank;

g. a first nip roller pair, defined by a first one of said first rollers and a first one of said second rollers, for bringing said first and second webs into close proximity one with another and hence defining the start of said path for said tobacco leaves;

h. a second nip roller pair, defined by a second one of said first rollers and a second one of said second rollers, for permitting said first and second webs to diverge one from another and hence defining the end of said path for said tobacco leaves due to separation of said first and second webs one from another thereat;

i. said first roller means guiding said first web of said first pair along a continuous path traveling beneath said tanks from said second nip roller pair to said first nip roller pair;

j. said second roller means guiding said second web of said first pair along a continuous path traveling above said tanks from said second nip roller pair to said first nip roller pair;

k. a first oven having a pair of oven chambers;

l. a second pair of moving flexible webs, space between said second pair of webs defining a path of conveyance for tobacco leaves traveling with said second pair of webs serially through both chambers of said first oven, said second pair of webs being closely spaced together and parallel one with another along said path through said oven, said second pair of webs being positioned to receive tobacco leaves from said first pair of moving continuous flexible webs proximate said second nip roller pair, for conveying said tobacco leaves along an essentially horizontal path through said oven pressed between said webs of said second pair;

i. said webs of said second pair being substantially opaque and impermeable to air;

ii. an upper one of said webs of said second pair being hydrophilic and pressing downwardly on said tobacco leaves and said lower web while conveying said tobacco leaves through said first oven;

m. a second oven;

n. a third pair of moving continuous flexible webs, space between said third pair of webs defining a path of conveyance for tobacco leaves traveling with said third pair of webs through said second oven, said third pair of webs being closely spaced together and parallel one with another along said path through said second oven, said third pair of webs being positioned to receive tobacco leaves from said first oven, for conveying said tobacco leaves back and forth along vertically spaced segments of an essentially horizontal path through said second oven pressed between said webs of said third pair;

i. said webs of said third pair being substantially opaque and impermeable to air;

ii. an upper one of said webs of said third pair being hydrophilic and pressing downwardly on said tobacco leaves and said lower web while conveying said tobacco leaves through said second oven;

o. roller means for defining the path of travel of said webs of said third pair as a series of vertically spaced horizontal passes in respectively alternating directions through said second oven.

26. Apparatus for reducing levels of undesirable materials in tobacco leaves preparatory to smoking thereof, comprising:

a. a plurality of tanks for holding aqueous solutions for sequential treatment of said tobacco leaves therein;

b. means for crushing stem portions of said leaves;

c. means for orienting said leaves with their main stem portions substantially longitudinally aligned;

d. means for conveying said leaves serially through said tanks while maintaining said leaves substantially unrolled;

e. means for removing water from surfaces of said leaves upon said leaves exiting a final one of said plurality of tanks;

f. first oven means for drying said leaves in a two stage process, in respective chambers of said first oven;

g. means for receiving said leaves from said leaf surface water removal means and conveying said leaves through said first oven means in a condition in which said leaves are shielded from light and air;

h. second oven means for drying said leaves; and i. means for receiving said leaves from said first oven means and for conveying said tobacco leaves back and forth along vertically spaced segments of an essentially horizontal path through said second oven in a condition in which said leaves are shielded from light and air.

* * * * *